US012442111B1

(12) United States Patent
Jhunjhunwala

(10) Patent No.: US 12,442,111 B1
(45) **Date of Patent: *Oct. 14, 2025**

(54) WOVEN TEXTILE FABRIC

(71) Applicant: Sachin Jhunjhunwala, Maharashtra (IN)

(72) Inventor: Sachin Jhunjhunwala, Maharashtra (IN)

( * ) Notice: Subject to any disclaimer, the term of this patent is extended or adjusted under 35 U.S.C. 154(b) by 0 days.

This patent is subject to a terminal disclaimer.

(21) Appl. No.: 18/902,025

(22) Filed: Sep. 30, 2024

(30) Foreign Application Priority Data

Jul. 19, 2024 (IN) ..... 202421055356

(51) Int. Cl.

| | |
|---|---|
| ***D03D 15/47*** | (2021.01) |
| ***D03D 13/00*** | (2006.01) |
| ***D03D 15/217*** | (2021.01) |
| ***D03D 15/283*** | (2021.01) |
| ***D03D 15/54*** | (2021.01) |
| ***D03D 15/567*** | (2021.01) |
| *D03D 1/00* | (2006.01) |

(52) U.S. Cl.
CPC ..... *D03D 13/00* (2013.01); *D03D 15/217* (2021.01); *D03D 15/283* (2021.01); *D03D 15/54* (2021.01); *D03D 15/567* (2021.01); *D10B 2201/02* (2013.01); *D10B 2331/04* (2013.01)

(58) Field of Classification Search
CPC .... D03D 15/47; D03D 13/008; D03D 15/225; D03D 15/283; D10B 2201/22; D10B 2331/04
See application file for complete search history.

(56) References Cited

U.S. PATENT DOCUMENTS

| | | | | |
|---|---|---|---|---|
| 11,976,390 | B2 * | 5/2024 | Jhunjhunwala | D03D 13/004 |
| 11,982,026 | B2 * | 5/2024 | Jhunjhunwala | D03D 15/225 |
| 12,000,068 | B2 * | 6/2024 | Jhunjhunwala | D03D 1/0017 |
| 2024/0076812 | A1 * | 3/2024 | Jhunjhunwala | D03D 1/0041 |

* cited by examiner

*Primary Examiner* — Robert H Muromoto, Jr.
(74) *Attorney, Agent, or Firm* — ROTHWELL, FIGG, ERNST & MANBECK, P.C.

(57) ABSTRACT

A woven textile fabric including a warp yarn and a weft yarn, wherein the warp yarn is made from any or a combination of natural or man-made fiber such that the warp yarn has 5-50% recycled fiber and the remaining fiber is generic, and wherein the warp yarn has a count ranging from 36-64 s, and wherein the warp yarn including number of ends ranging from 130-198.

9 Claims, No Drawings

WOVEN TEXTILE FABRIC

CROSS REFERENCE TO RELATED APPLICATION(S)

This application claims the benefit of Indian Patent Application No. 202421055356, filed on Jul. 19, 2024, the disclosures of which are herein incorporated by reference in their entirety.

TECHNICAL FIELDS

The present disclosure pertains generally to the field of textile industry. In particular, the present disclosure provides a textile fabric that can find utility as home textile. More particularly, the present disclosure relates to an enhanced eco-friendly recycled fabric.

BACKGROUND

Background description includes information that may be useful in understanding the present invention. It is not an admission that any of the information provided herein is prior art or relevant to the presently claimed invention, or that any publication specifically or implicitly referenced is prior art.

Often in textile manufacturing, it becomes necessary to scrap products for one reason or another. For example, it could be that the products, once manufactured, did not meet the desired specifications, or perhaps, the product was not as marketable as anticipated. Further textiles used by the consumer are thrown into the landfills have become a big global problem. Apparel made from natural fibers takes years to decompose, whereas man-made fibers do not self-decompose. Woolen clothes do decompose but release methane and carbon dioxide into the atmosphere. This contributes towards global warming. Synthetic fabrics in the landfill release nitrous oxide which is a powerful greenhouse gas. Besides, toxic substances pollute groundwater and surrounding soil.

With increasing demand and problems associated with the decomposition of Apparel, recycling and reusing textiles, fibers, and waste materials is an effective way to build sustainability in the apparel industry. Numerous recycled textile fabrics are reported in the literature, and available in markets that are used by retailers and consumers. However, these recycled textile fabrics are of low quality, non-durable, and exhibit poor elasticity, chemical resistance, tensile strength, pilling, and the like.

Furthermore, existing recycled fabrics suffer from lack of strength being provided to the warp yarns, and usually the recycled fabric per se does not form a key part of the overall fabric as regards the weight of the fabric is concerned.

There is, therefore, a need in the art to provide a new and improved textile fabric that is comfortable, breathable, exhibits high strength, low piling, and the likes that can find utility as a home textile. The present disclosure satisfies the existing needs, as well as others, and alleviates the shortcomings associated with conventional recycled fabrics.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability.

OBJECTS

An object of the present disclosure is to provide a textile fabric that overcomes the deficiencies associated with the conventional woven textile fabric.

Another object of the present disclosure is to provide a textile fabric that exhibits high tensile strength and good piling resistance.

Another object of the present disclosure is to provide a textile fabric that is durable, wrinkle resistant, and comfortable to human skin.

Another object of the present disclosure is to provide a textile fabric that is economical and easy to manufacture.

Another object of the present disclosure is to provide a textile fabric that is demonstrates a pilling of over 3 after 1000 rubs.

SUMMARY

The present disclosure pertains generally to the field of textile industry. In particular, the present disclosure provides a textile fabric that can find utility as home textile.

An aspect of the present disclosure relates to a woven textile fabric, said fabric comprising a warp yarn and a weft yarn, wherein warp yarn is made from natural/man-made fiber having 5-50% recycled component/portion, and the balance portion/component 50-95% of the warp yarn is generic. Therefore, in sum, recycled portion of the warp yarn ranges between 5-50% of the total weight of the warp yarn. In another aspect, the warp yarn count is between 36-64 s. In another aspect, generic fiber can be mixed with the recycled fiber to give strength to the warp yarn. In yet another aspect, the warp yarn can include 130-198 ends in the fabric.

In another aspect, weft yarn can be 100% recycled polyester texturized yarn having total separable picks of 440 to 1050, and a Denier range between 12D to 25D.

In an exemplary aspect, total content of natural fibre including recycled natural fibre in the fabric is a minimum of 25% of the weight of the fabric. In another exemplary and non-limiting embodiment, recycled fibre in the overall fabric constitutes at least 47.5% of the total weight of the fabric going up to a maximum of 75% of the weight of the fabric.

In an exemplary aspect, the recycled fabric can be dyed in solid colours, printed, or even digitally printed. The finally configured fabric is such that even after using recycled warp and weft yarns in the fabric, the pilling of the fabric after dying and finishing is over 3 post 1000 rubs.

In an aspect, the resultant finished fabric even after using recycled yarn can have a shrinkage less than 5% in wrap and weft.

Various objects, features, aspects and advantages of the inventive subject matter will become more apparent from the following detailed description of preferred embodiments, along with the accompanying drawing figures in which like numerals represent like components.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within scope of the present disclosure.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims.

Unless the context requires otherwise, throughout the specification which follows, the word "comprise" and variations thereof, such as, "comprises" and "comprising" are to be construed in an open, inclusive sense that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

The expression "rating of 3 or above" as used herein throughout the present disclosure, in the context of the fabric tested for pilling after 1000 rubs, generally denotes low pilling tendency of the fabric being tested. Specifically, when the pilling tendency of the finished fabric is measured by any of the standard methods ASTM D4970 or ISO 12945-2:2014 and rated on a scale/grade/rating of 1-5, the scale/rating/grade 1 indicates very severe pilling and scale/rating/grade 5 indicates no pilling after the specified number of rubs. The fabric of the present disclosure exhibits the rating of 3 or 4 or 5 after 1000 rubs or cycles, i.e. the woven textile fabric of the present disclosure has low pilling tendency.

The term "woven textile fabric", as used herein throughout the present disclosure, in the context of the fabric being tested for pilling tendency or pilling resistance denotes the dyed, bleached or printed fabric, or otherwise a fabric that is substantially ready for use (e.g. consumer use) without need to be subjected to any further processing that can alter its pilling tendency or pilling resistance. For example, the raw woven fabric may be subjected to dying and/or printing and/or bleaching process(es) to produce the ready to sale (or ready to use) fabric. Such fabric is subjected to the test for measurement of pilling resistance or pilling tendency.

In some embodiments, the numbers expressing quantities of ingredients, properties such as concentration, and so forth, used to describe and claim certain embodiments of the invention are to be understood as being modified in some instances by the term "about." Accordingly, in some embodiments, the numerical parameters set forth in the written description are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable.

The recitation of ranges of values herein is merely intended to serve as a shorthand method of referring individually to each separate value falling within the range. Unless otherwise indicated herein, each individual value is incorporated into the specification as if it were individually recited herein.

The headings and abstract of the invention provided herein are for convenience only and do not interpret the scope or meaning of the embodiments.

Various terms as used herein are shown below. To the extent a term used in a claim is not defined below, it should be given the broadest definition persons in the pertinent art have given that term as reflected in printed publications and issued patents at the time of filing.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The present disclosure pertains generally to the field of textile industry. In particular, the present disclosure provides a textile fabric that can find utility as home textile.

The present disclosure pertains generally to the field of textile industry. In particular, the present disclosure provides a textile fabric that can find utility as home textile.

An aspect of the present disclosure relates to a woven textile fabric, said fabric comprising a warp yarn and a weft yarn, wherein warp yarn is made from any or a combination of natural and/or man-made fiber such that the warp yarn has 5-50% recycled component/portion, and the balance portion/component 50-95% of the warp yarn is generic. Therefore, in sum, recycled portion of the warp yarn ranges between 5-50% of the total weight of the warp yarn.

Recycled warp yarn refers to yarn that has been made from recycled materials and is specifically used for the warp threads in weaving. In weaving, the warp yarns are the threads that run lengthwise on a loom and are typically under high tension during the weaving process. Using recycled materials for warp yarns is part of sustainable practices in textile production, reducing the environmental impact by reusing materials instead of creating new ones from raw resources. Recycled warp yarn can be made from various sources such as recycled polyester, recycled cotton, or other recycled fibers. These materials are processed to create yarn that meets the strength and quality requirements necessary for weaving. Using recycled yarns in weaving not only conserves resources but also reduces waste and energy consumption associated with textile manufacturing.

In an aspect, while 5-50% of the warp yarn is made from recycled material exemplified above, as disclosed above, the remaining balance portion of the warp yarn is generic, and therefore can be made of natural and/or man-made fibers, wherein Natural Fibers can include but not limited to cotton, linen, wool, silk, and hemp, and man-made fibers (synthetic fibers) can include but not limited to Polyester, Nylon, Acrylic, Rayon, and Polypropylene. The choice between natural and man-made fibers depends on factors like desired properties (such as breathability, durability, or moisture-wicking), sustainability considerations, and the intended use of the fabric. Increasingly, blends of natural and synthetic fibers are also used to combine the best properties of both types.

In another aspect, the warp yarn count is between 36-64 s. Warp yarn count refers to a measurement used in textiles to denote the fineness or thickness of the yarns used for the warp (lengthwise) threads in weaving, and helps determine the density, strength, and appearance of woven fabrics. In yet another aspect, the warp yarn can include 130-198 ends (determined based on weight of the yarn, yarn count, and length of warp) in the fabric, both of which above parameters together with the range of the amount of recycled portion in the overall warp yarn enables the desired strength and properties of the fabric.

In another aspect, weft yarn can be 100% recycled polyester texturized yarn having total separable picks of 440 to 1050, and a Denier range between 12D to 25D.

In an exemplary aspect, total content of natural fibre including recycled natural fibre in the fabric is a minimum of 25% of the weight of the fabric. In another exemplary and non-limiting embodiment, recycled fibre in the overall fabric constitutes at least 47.5% of the total weight of the fabric going up to a maximum of 75% of the weight of the fabric.

In an exemplary aspect, the recycled fabric can be dyed in solid colours, printed, or even digitally printed. The finally configured fabric is such that even after using recycled warp and weft yarns in the fabric, the pilling of the fabric after dying and finishing is over 3 post 1000 rubs.

In an aspect, the resultant finished fabric even after using recycled yarn can have a shrinkage less than 5% in wrap and weft.

In an embodiment, the fabric comprises any of: a satin weave, a percale weave and a twill weave. In an embodiment, the fabric comprises of a satin weave. In an embodiment, the fabric comprises of a percale weave. In a preferred embodiment, the fabric comprises of a twill weave. In some embodiments, the woven textile fabric is used as a bedding product, the bedding product being selected from: a bed sheet, a pillow case, a comforter, a coverlet, a pillow sham, a dust ruffle, a blanket, a bedspread, and a duvet cover. The advantageous fabric realized in accordance with embodiments of the present disclosure can find utility as home textiles.

The woven twill textile fabric, realized in accordance with embodiments of the present disclosure can be made using any apparatus/loom known to a person skilled in the pertinent art. In an embodiment, fabric is prepared by using a pick insertion apparatus such as an air-jet or a Sulzer pick insertion apparatus. However, utilization of any other pick insertion apparatus, as known to or appreciated by a person skilled in the art to serve its intended purpose as laid down in the present disclosure, is completely within the scope of the present disclosure.

Table 1 herein-below provides different exemplary fabric compositions along with their characteristics used for preparing fabrics.

TABLE 1

Characteristics of Warp and weft yarns

| Sr. No. | Yarn |
|---|---|
| Yarn 1 (WARP YARN) | 5% Recycled Polyester + 95% Cotton |
| Yarn 2 (WARP YARN) | 10% Recycled Cotton + 90% Cotton |
| Yarn 3 (WARP YARN) | 15% Recycled Polyester + 85% Cotton |
| Yarn 4 (WARP YARN) | 15% Recycled Cotton + 85% Cotton |
| Yarn 5 (WARP YARN) | 15% Recycled Polyester + 15% Recycled Cotton + 70% Cotton |
| Yarn 6 (WARP YARN) | 45% Recycled Polyester + 55% Cotton |
| Yarn 7 (WARP YARN) | 45% Recycled Cotton + 50% Cotton |
| Yarn 8 (WEFT YARN) | 100% Recycled Polyester texturized yarn |

Table 2 below provides characteristics of different fabrics prepared by using different combinations of yarns, provided in Table 1, in the warp and weft.

TABLE 2

Characteristics of woven fabrics

| Sr. No. | Warp | Warp Count/ No. of End | Weft | Total separable picks of/ Denier | Overall Recycled content in fabric | Piling (1-5) | Tensile Strength (1-10) |
|---|---|---|---|---|---|---|---|
| 1. | Yarn 1 | 40 s/140 end s | Yarn 8 | 500/15 D | 47.5 | 5 | 9 |
| 2. | Yarn 2 | 40 s/140 end s | Yarn 8 | 500/15 D | 55 | 4.5 | 8.5 |
| 3. | Yarn 3 | 60 s/140 end s | Yarn 8 | 500/15 D | 57.5 | 4.25 | 8.25 |
| 4. | Yarn 4 | 60 s/140 end s | Yarn 8 | 500/15 D | 57.5 | 4.10 | 8.20 |
| 5. | Yarn 5 | 60 s/140 end s | Yarn 8 | 500/15 D | 65 | 3.75 | 7.75 |
| 6. | Yarn 6 | 60 s/180 end s | Yarn 8 | 500/15 D | 72.5 | 4 | 8 |
| 7. | Yarn 7 | 60 s/180 ends | Yarn 8 | 500/15 D | 72.5 | 4 | 7.75 |

The fabric of the present disclosure exhibits a low tendency of pilling, while achieving the balance between pilling resistance and the tensile strength. Further, the fabric of the present invention is significantly economical owing to usage of recycled cotton and/or recycled polyester.

While the foregoing describes various embodiments of the invention, other and further embodiments of the invention may be devised without departing from the basic scope 10 thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

The invention claimed is:

1. A woven textile fabric, comprising a warp yarn and a weft yarn, wherein the warp yarn is made from any or a combination of natural or man-made fiber such that the warp yarn has 5-50% recycled fiber and the remaining fiber is generic, and wherein the warp yarn has a count ranging from 36-64 s, and wherein the warp yarn comprises number of ends ranging from 130-198.

2. The woven textile fabric as claimed in claim 1, wherein recycled fiber is selected from any or a combination of recycled polyester and recycled cotton and Recycled Natural Fiber and Recycled Man made Fiber.

3. The woven textile fabric as claimed in claim 1, wherein the generic fiber is cotton.

4. The woven textile fabric as claimed in claim 1, wherein the weft yarn is 100% recycled polyester texturized yarn having total separable picks ranging from 440 to 1050, and a Denier value ranging between 12D to 25D.

5. The woven textile fabric as claimed in claim 1, wherein total content of natural fiber including recycled natural fiber in the fabric is a minimum of 25% of the weight of the fabric.

6. The woven textile fabric as claimed in claim 1, wherein the recycled fiber in the overall fabric constitutes at least 47.5% of the total weight of the fabric going up to a maximum of 75% of the weight of the fabric.

7. The woven textile fabric as claimed in claim 1, wherein the recycled fabric is dyed in a solid colour or is printed.

8. The woven textile fabric as claimed in claim 1, wherein the finally configured fabric is configured to maintain, even after using recycled warp and weft yarns in the fabric, a pilling of over 3 and above post 1000 rubs after dying and finishing.

9. The woven textile fabric as claimed in claim 1, wherein the resultant finished fabric even after using recycled yarn has a shrinkage less than 5% in wrap and weft.

* * * * *